US011486148B2

(12) United States Patent
Bassetto et al.

(10) Patent No.: US 11,486,148 B2
(45) Date of Patent: Nov. 1, 2022

(54) SUPPORT FOR RAISED FLOORS

(71) Applicant: Profilitec S.p.A. Socio Unico, Isola Vicentina (IT)

(72) Inventors: Andrea Bassetto, Isola Vicentina (IT); Roderick Egli, Isola Vicentina (IT)

( * ) Notice: Subject to any disclaimer, the term of this patent is extended or adjusted under 35 U.S.C. 154(b) by 0 days.

(21) Appl. No.: 16/973,184

(22) PCT Filed: Mar. 20, 2019

(86) PCT No.: PCT/IB2019/052265

§ 371 (c)(1),
(2) Date: Dec. 8, 2020

(87) PCT Pub. No.: WO2019/239222

PCT Pub. Date: Dec. 19, 2019

(65) Prior Publication Data

US 2021/0262243 A1 Aug. 26, 2021

(30) Foreign Application Priority Data

Jun. 15, 2018 (IT) ..... 102018000006345

(51) Int. Cl.
*E04F 15/024* (2006.01)

(52) U.S. Cl.
CPC ..... *E04F 15/02482* (2013.01)

(58) Field of Classification Search
CPC ..... E04F 15/02464; E04F 15/0247; E04F 15/02482; E04F 2015/02127
See application file for complete search history.

(56) References Cited

U.S. PATENT DOCUMENTS 3,318,057 A * 5/1967 Norsworthy ..... E04F 15/02482 52/126.6
6,332,292 B1 * 12/2001 Buzon ..... E04D 11/007 248/351
6,363,685 B1 * 4/2002 Kugler ..... E04F 15/02183 52/126.6
6,520,471 B2 * 2/2003 Jones ..... E01C 5/223 248/346.3
7,918,059 B2 * 4/2011 Repasky ..... E04F 15/0247 52/263
8,297,004 B2 * 10/2012 Knight, III ..... E04D 11/007 52/126.6
8,429,860 B2 * 4/2013 Kugler ..... F16B 7/048 52/126.6

(Continued)

FOREIGN PATENT DOCUMENTS

DE 202015002483 5/2015

*Primary Examiner* — James M Ference
(74) *Attorney, Agent, or Firm* — Themis Law

(57) ABSTRACT

A support for raised floors includes a base and a head coupled to the base, the head having a support body and a tilting element laid on the support body, the tilting element having a plate-shaped portion with an upper surface that is partially flat for supporting a building elements, protrusions emerging from a circular crown of the lower surface of the plate-shaped portion to create a profile shaped as a spherical cap ring, the outer edge of the circular crown being near the outer perimeter of the plate-shaped portion, the support body having an upper surface defining a cavity that is counter-shaped to the spherical cap ring at the protrusions emerging from the tilting element.

4 Claims, 3 Drawing Sheets

(56) References Cited

U.S. PATENT DOCUMENTS 8,490,342 B2 * 7/2013 Greaves ..... E04F 15/02482 52/126.5
8,850,753 B2 * 10/2014 Tabibnia ..... E04F 15/02452 52/126.6
8,898,999 B1 * 12/2014 Kugler ..... E04F 15/02464 52/747.1
9,410,296 B2 * 8/2016 Tabibnia ..... E04F 15/0247
9,683,375 B2 * 6/2017 Kugler ..... E04F 15/02452
9,874,029 B2 * 1/2018 Kugler ..... E04F 15/0247
9,879,385 B2 * 1/2018 Tabibnia ..... F24D 3/127
2002/0148173 A1 * 10/2002 Kugler ..... E04F 15/02183 52/126.6
2003/0070372 A1 * 4/2003 Favero ..... E04F 15/02482 52/220.1
2004/0035064 A1 * 2/2004 Kugler ..... E04F 15/02452 52/126.6
2004/0261329 A1 * 12/2004 Kugler ..... E04F 15/02183 52/126.6
2007/0186498 A1 * 8/2007 Buzon ..... E04F 15/02183 52/263
2008/0222973 A1 * 9/2008 Lee ..... E04F 15/02488 52/126.1
2009/0183442 A1 * 7/2009 Repasky ..... E04F 15/02183 52/126.6
2010/0050457 A1 * 3/2010 Knight, III ..... E04F 15/0247 33/836
2010/0051763 A1 * 3/2010 Knight, III ..... E04D 11/007 248/161
2013/0219809 A1 * 8/2013 Tabibnia ..... E04F 15/02482 52/126.6
2014/0308076 A1 * 10/2014 Tabibnia ..... E01C 5/00 404/99
2016/0040439 A1 * 2/2016 Pelc ..... E04F 15/203 52/126.6
2016/0244979 A1 * 8/2016 Greaves ..... E04F 15/02476
2017/0152635 A1 * 6/2017 Tabibnia ..... E04F 15/02476
2017/0152665 A1 * 6/2017 Pelc, Jr. ..... E04F 15/02482
2021/0262243 A1 * 8/2021 Bassetto ..... E04F 15/0247

* cited by examiner

SUPPORT FOR RAISED FLOORS

Definitions

In the present patent, the term "building elements" means floor covering materials such as, by way of example, tiles and planks.

FIELD OF APPLICATION

The present invention is generally applicable to the building sector and refers to the construction of raised floors.

More in detail, the present invention relates to supports and supporting feet for raised floors.

BACKGROUND ART

As is known, special ceilings and floors are used in many environments, especially in work environments such as offices, warehouses or other. This allows to arrange with ease the sub-services and to manage uneven floors or ceilings that would require particularly expensive interventions.

Another situation in which special floors, often of the raised type, are used is the case of temporary structures such as prefabricated sheds, tensile structures and, in general, structures that must be assembled and disassembled on generally uneven surfaces such as a field or similar.

Typically, raised floors have a load-bearing structure laid on the ground and above which the flooring is arranged. The latter is typically, but not necessarily, made up of tiles laid on the load-bearing structure.

The load-bearing structure comprises a plurality of supports on whose head there is a plate that supports the edges of adjacent tiles.

The raising of the floor can be characterized by different heights according to specific needs. In this context, in order to avoid having a high number of supports in stock (each dedicated to a specific height of the raised floor), supports having the head adjustable in height with respect to the base are known. This is typically achieved by threading the head so that it can be screwed into the base. The amount of screwing determines the height of the support.

However, also in this case, a considerable number of components in stock is present since the range of heights that the supports must have is particularly high and such as not to allow all of them to be obtained with a single head-base pair of the support.

More in detail, a first considerable problem is constituted by the fact that the minimum height required for a support is very low and such as to prevent, with the same, the maximum heights of the range of heights generally desired on the market.

For this reason, supports are known that, in addition to the head and the base, have one or more extension elements so as to make the support modular and obtain particularly different heights simply by adding extension elements.

However, these extension elements are generally screwed onto the base and always receive the head of the support by screwing. In this case, therefore, they still present a height which is not contained since they must guarantee the screwing of the head and on the base such as to make the pin stable as a whole.

It is also known that the supports can have fixed head and tilting head. In fact, due to the disconnection of the support surface or the desired slope of the same (be it a floor or the ground), the load-bearing structure has the task of restoring the correct horizontality of the floor, i.e. in general of the tiles or of the building elements that constitute the floor.

Although, as mentioned, the supports are adjustable, the flatness of the floor cannot be managed only with such adjustment. The inclination of the support surface would turn into the inclination of the head of the supports if it were exclusively fixed. This typically requires arranging specially shaped wedges under the supports to restore the horizontality of the head. Since this solution is obviously inconvenient, supports having the tilting head so that the weight of the building elements which rest on it induces the automatic angle in a horizontal direction are known.

However, even this aspect does not help to contain the number of supports or components in stock. In fact, this forces the production of two sets of heads (fixed and pivoting) for the same type of supports and, consequently, to provide two sets of heads in stock.

Therefore, heads for supports for raised floors that are pivoting are known, but which are shaped to be fixed so as to have a single set of heads. Typically, these heads have a support body on which a tilting element rests and an accessory which allows the latter to be locked in position.

The tilting element provides a counter-shaped cavity on the lower part, which is completely shaped like a spherical cap, and on the support body.

Although this allows to have in the same head both the fixed component and the tilting component, such an execution certainly makes the head particularly thick in height and therefore unsuitable for use in the case of floors with little raising. In other words, this solution does not allow the use of a single head for low raising flooring supports.

It follows that also in this case the modularity of the supports does not allow to reduce the number of components in stock and therefore the costs of production and management of the same.

PRESENTATION OF THE INVENTION

The object of the present invention is to overcome at least partially the above-mentioned drawbacks by providing a support for raised floors whose tilting head can be fixed in order to transform it into a fixed head.

Another object is that this head be as less thick as possible so as to make it suitable for any support, whatever the height of the floor raising.

A further object is that the support of the invention is suitable for being used to make raised floors of any height.

In this sense, a particular object is that the support of the invention can comprise the same head and the same base, whatever the raising height of the floor to be obtained.

What has just been said translates into the fact that an object of the present invention is to provide a support for raised floors that includes the fewest possible components in stock to ensure the execution of any raised floor whatever the desired raising height.

Said objects, as well as others which will become clearer below, are achieved by a support for raised floors according to the following claims, which are to be considered as an integral part of the present patent.

In particular, it comprises a base that can be positioned on a support surface and a head operatively coupled to the base. Moreover, the head itself comprises at least one support body and at least one tilting element laid on the support body.

In other words, the head is configured to be tilting. However, according to an aspect of the invention there are also stable coupling means of the tilting element to the support body. This means that the head can advantageously pass from a tilting configuration to a fixed configuration.

As far as the tilting element is concerned, it comprises at least one plate-like portion having an at least partially flat upper surface for supporting building elements. Then there are one or more protrusions emerging from a circular crown of the lower surface of the plate-like portion to generally form a profile shaped as a spherical cap ring.

At the same time, the support body has a cavity on the upper surface. It is at least partially counter-shaped on the spherical cap just mentioned at least at the protrusions emerging from the tilting element. This allows the tilting coupling between the support body and the element that rests on it. The stable coupling means, as mentioned, will allow the reciprocal tilting movement to be blocked at any time.

According to another aspect of the invention, the outer edge of the circular crown from which the protrusions of the plate-like portion emerge, is at least proximate, if not coincident, to the outer perimeter of the plate-like portion.

In other words, the portion of tilting element shaped as a spherical cap ring is formed near the edge of the swinging element and not in the middle or near the centre.

First of all, this allows the support surface of the tilting element to be increased geometrically on the support body. Still advantageously, it follows that the spherical cap ring can be full or made from ribs or other, with considerable savings in production costs and materials used.

However, the most advantageous aspect is that, again from a geometric point of view, this allows to obtain remarkable inclinations while maintaining limited the thickness of the head. In particular, the greater the radius of the outer circumference of the circular crown, the greater the radius of the inner circumference can be with the same inclinations of the tilting element with respect to the support body. This allows to avoid making the highest or thickest parts of the spherical cap and, consequently, to reduce the overall thickness of the head.

Still advantageously, therefore, since the head is not very high, its coupling with a low base allows the making of raised floors of minimum height. However, the same head can be used to make also raised floors of consistent height.

This allows, still advantageously, the reduction of the number of components necessary to achieve raised floors of different heights. This decrease is accentuated by the fact that the head itself can be both fixed and tilting.

According to another aspect of the invention, the head is coupled to the base by the interposition of at least one extension element.

However, while the head is typically screwed to the base, according to a further aspect of the invention, the extension element is a cylinder having, at least near its bottom, first coupling means, of the bayonet type, to the base and at least near its head second coupling means, also of the bayonet type, to another extension element. Moreover, the cylinder comprises a threaded inner surface to couple stably with the thread present on the lateral surface of the head.

In other words, the coupling by screwing of the head can take place directly on the base, in the case of minimum raisings, or on an extension element. This advantageously allows the supports to be modularized and obtained with only three elements: a base, a head that can be both fixed and tilting, and one or more extension elements all equal to each other.

Still advantageously, the realization of bayonet couplings between the extension elements and between these and the base allows extension elements to be made of a limited length. While the screwing, in fact, requires a thread of adequate length to ensure stability, the bayonet coupling is stable even with limited overlap of the two ends to be mutually coupled, ensuring stability to the structure. This advantageously allows the free adjustment of the height of supports, ensuring substantially any heights, since it can be a particularly short extension element.

Also the base, still advantageously, can be particularly short since it must be able to ensure the screwing of the head only for low raising floors, therefore being stable per se even with a not excessive screwing.

From all this it follows that with only three different elements (base, head and extension element) configured in such way it is possible to obtain supports for raised floors of any height. The production and warehouse management of supports according to the invention (only three elements to be provided) is certainly less problematic and less expensive than in the known art.

BRIEF DESCRIPTION OF THE DRAWINGS

Further features and advantages of the invention will become more evident in light of the detailed description of a preferred but not exclusive embodiment of a support for raised floors according to the invention, illustrated by way of non-limiting example with the aid of the accompanying drawings, wherein.

DETAILED DESCRIPTION OF SOME PREFERRED EXEMPLARY EMBODIMENTS

Figure 1:
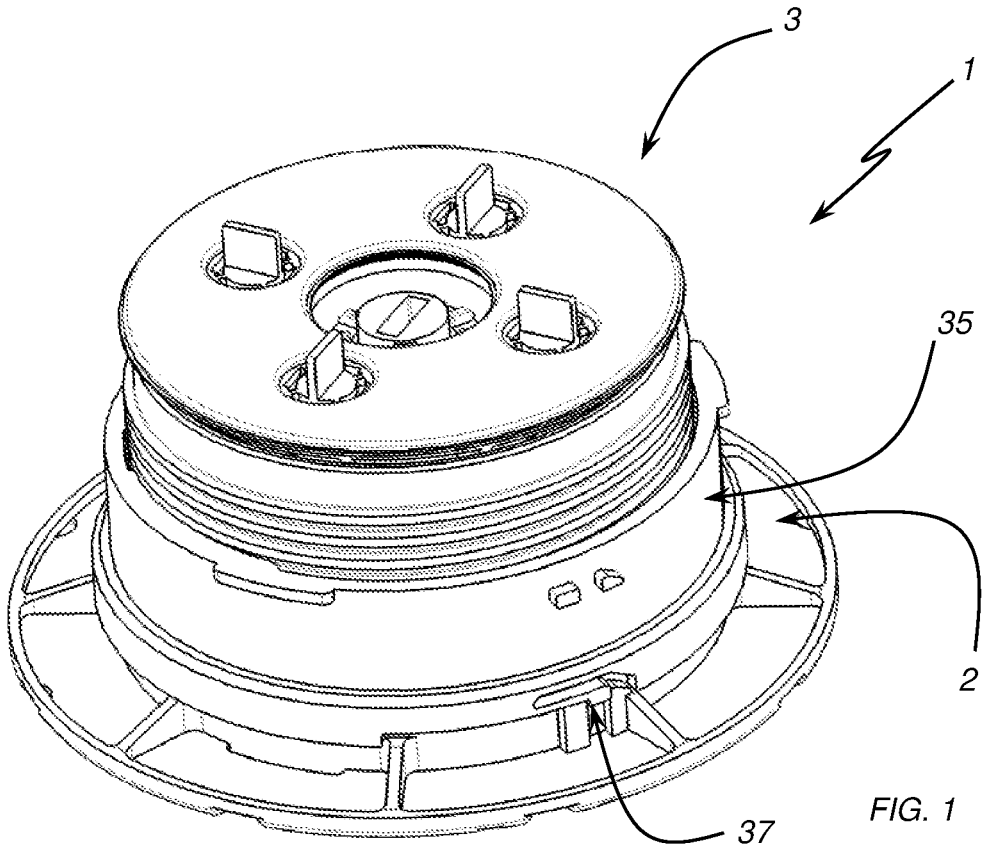
FIG. 1 represents a support for raised floors according to the invention in axonometric view.
Figure 2:
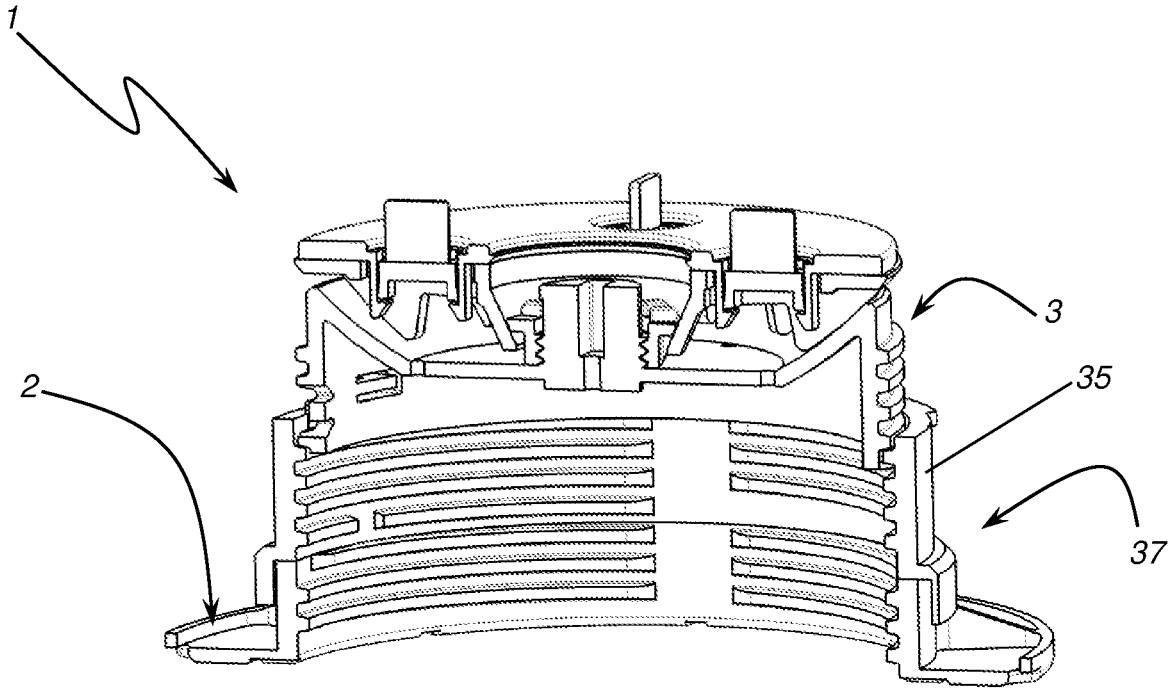
FIG. 2 represents the support of FIG. 1 in sectioned view.
Figure 3:
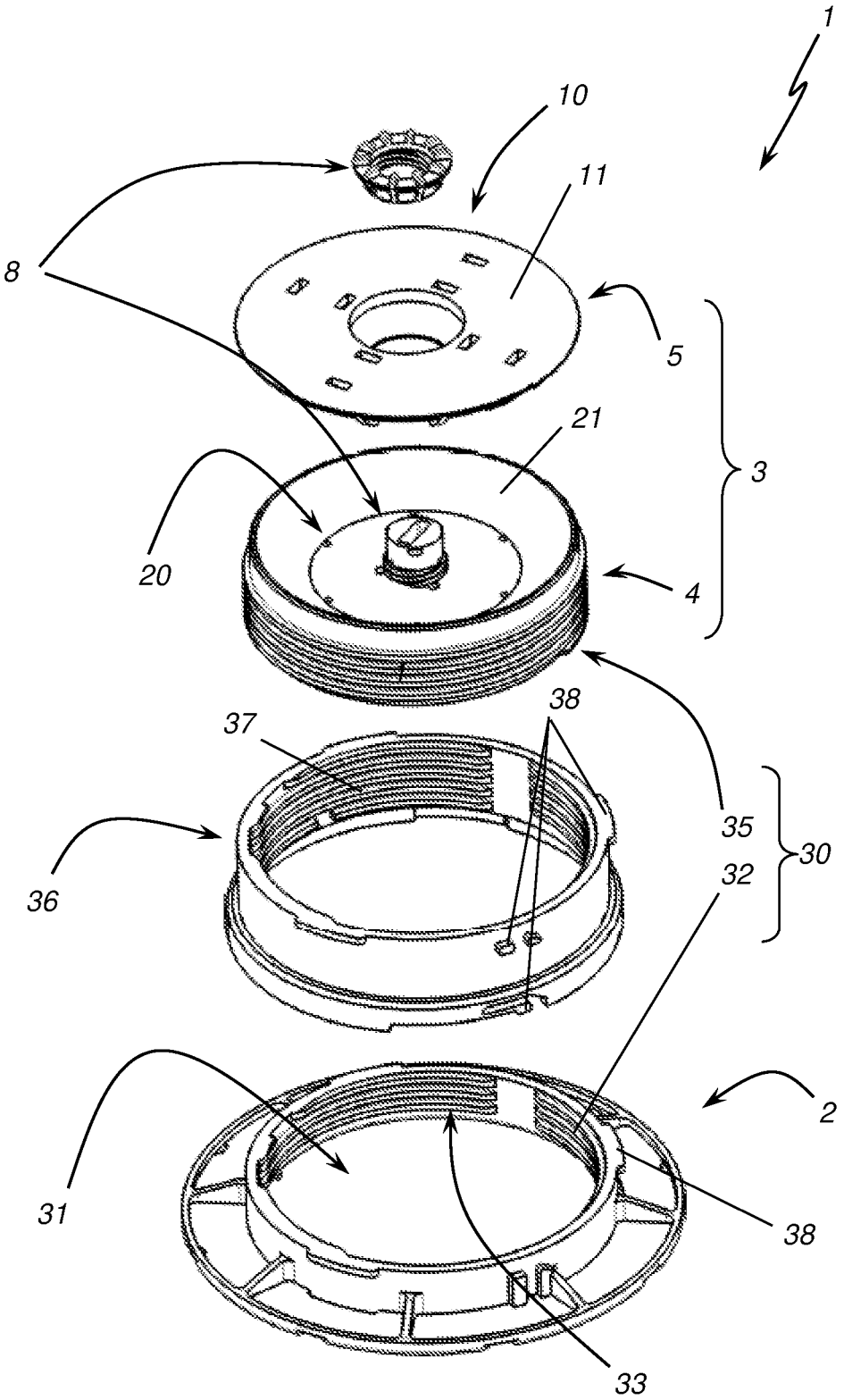
FIG. 3 represents the support of FIG. 1 in exploded view.
Figure 4:
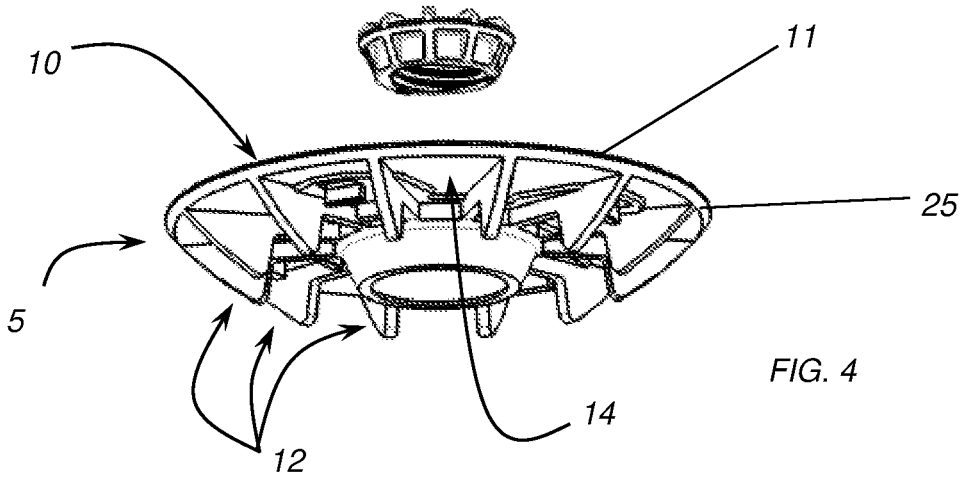
FIGS. 4 and 5 show details of a support according to the invention.
Figure 5:
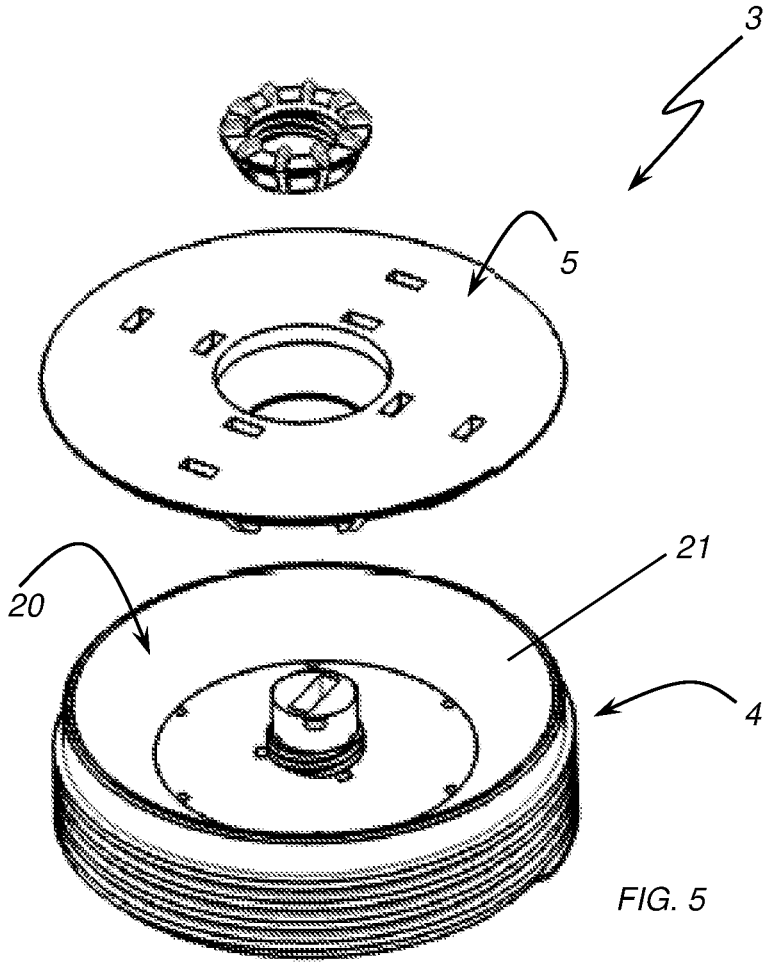

With reference to the above figures, a support 1 for raised floors is described.

Like the known supports, it is modular being made by assembling multiple components. In this sense, the support 1 of the invention comprises a base 2, which can be positioned on a support surface, and a head 3 operatively coupled to the base 2.

In turn, the head 3 comprises a support body 4 and a tilting element 5 laid on the support body 4. It follows that the head 3 is of the tilting type.

However, according to an aspect of the invention, the support 1 comprises stable coupling means 8 of the tilting element 5 to the support body 4. Consequently, the head 3 can be both fixed and tilting, advantageously decreasing the number of components to be produced to obtain supports 1 for any need.

As far as the tilting element 5 is concerned, it comprises first of all a plate-like portion 10 having the upper surface 11 partially flat to support the building elements constituting the walking area of the raised floor. It is clear that the dimensions and the shape of the flat parts of the upper surface 11 of the plate-like portion 10 can be of any type without any limit for the invention. In particular, the aforementioned upper surface 11 can be totally flat.

In order to achieve the tilting movement with respect to the support body 4, the tilting element 5 also comprises a plurality of protrusions 12 emerging from a circular crown of the lower surface 14 of the plate-like portion 10 in order to achieve an overall profile shaped as a spherical cap ring.

In deeper detail of the described embodiment, the aforementioned protrusions 12 are a plurality of radial ribs. However, such aspect must not be considered as limiting for the present invention. According to some variant embodiments not shown in the drawings, in fact, circular ribs joining the radial ribs are added to the radial protrusions. Furthermore, in a particular embodiment the emerging protrusion is constituted by a full spherical cap ring.

In any case, to ensure the tilting movement, the support body 4 has a cavity 20 on the upper surface 21. This cavity 20 is partially counter-shaped on the aforementioned spherical cap at the emerging protrusions 12 of the tilting element 5.

Previously the objective was to make a support 1 composed of the fewest possible components and ensuring the widest possible range of heights. In these terms, the lowest heights are undoubtedly the most problematic to obtain. In particular, the association between the head 3 and the base 2, whether direct or, as will be seen shortly, through the interposition of further elements, must be able to provide the minimum heights.

For this reason, according to another aspect of the invention, the outer circumference of the circular crown which delimits the protrusions 12 is in proximity, if not coincident, with the outer perimeter 25 of the plate-like portion 10.

Since the spherical cap ring thus identified is responsible both for the mechanical support on the support body 4 of the tilting element 5 and for the inclination of the latter, the maximization of the radius of the outer circumference of the circular crown allows to maximize even more the radius of the inner circumference. In other words, the displacement of the circular crown towards the periphery of the plate-like portion 10 allows to increase the area of possible contact between the spherical cap ring and the support body 5, or to reduce the dimensions of the circular crown with the same contact area.

In the second case, which coincides with the maximization of the radius dimension of the inner circumference of the circular crown, the thickness of the spherical cap ring identified by the protrusions 12 is minimized, thus allowing to minimize the thickness of the whole head 3.

Advantageously, therefore, for the same base 2 the head 3 results reduced in thickness allowing to obtain minimized floor raising heights. In other words, advantageously, the head 3 of the support 1 of the invention can be used for any raised floor, even in the case of particularly limited raised floors.

What follows, still advantageously, is a considerable reduction of the components to be produced for the realization of supports 1 for any type of raising of a floor since the head 3 is unique both in the need to have supports with a tilting head and in the need to have supports with a fixed head, as well as in respect of any desired raising.

According to another aspect of the invention, head 3 and base 2 are coupled by screw means 30. More in detail, the base 2 centrally presents a substantially cylindrical through hole 31 having a second thread 32 on the inner surface 33. At the same time, the support body 4 of the head 3 is also cylindrical and has a first thread 35 on the lateral surface 34 which is adapted to mesh with the second thread 32 of the base 2.

In this way, advantageously, a slightly thick head 3 like the one just described, which must be screwed into the through hole 31 of the base 2 also allows the base 2 to be slightly thick to ensure the stability of the coupling. Advantageously, therefore, the raising of such support 1 can be minimized by obtaining very limited heights.

However, it is clear that also this aspect should not be considered as limiting for the invention, the coupling between base 2 and head 3 being able to be obtained also with different modes.

Earlier it was also stated that it is often necessary to obtain high raising heights. In this sense, according to a further aspect of the invention, the head 3 can be coupled to the base 2 by the interposition of one or more extension elements 36.

In other words, the extension elements 36 are shaped to allow the support to be modularly extended to any heights. Also in this context, therefore, the advantage is obtained of being able to use the same base 2 and the same head 3 to make any support 1 necessary for the raised floor that is being laid. The only additional element is, advantageously, only the extension element 36 which is also unique and whose number determines the effective height to be reached with the support 1.

It is therefore evident that both the production phase of such a support 1 with respect to the equivalent supports of prior art is advantageously improved, and the warehouse management of the components thereof which, in fact, are only three.

Since the extension element 36 must couple with the head 3, in the embodiment described it is cylindrical and has the inner surface 37 threaded.

At the same time, it must mate either with other extension elements 36 or with the base 2. Since the latter is not very thick and at the same time having to ensure the stability of the support even in case of particularly high raising heights, according to another aspect of the invention the extension element 36 has at each end coupling means 38 to the base 2 or to another extension element 36. More in detail, the coupling means 38 are of the bayonet type.

Advantageously, therefore, the coupling of the extension elements 36 to each another or to the base 2 is quick and easily obtainable.

Still advantageously, the bayonet coupling allows a strong mechanical stability of the coupling in a limited space allowing to maintain head 3, base 2 and extension elements 36 of limited thickness in order to ensure the obtainment of any raising desired.

In light of the foregoing, it is understood that the support for raised floors of the invention achieves all the prefixed purposes.

In particular, with respect to the known art the support has minimized number of components that constitute itself and which allow any raising to be obtained.

In fact, regarding the head, it is either tilting or fixed by the use of a single accessory.

The head, base and extension element can be made particularly short so as to allow any raising height among those necessary in the prior art.

Moreover, it follows that the support of the invention achieves all the prefixed purposes with a minimum number of components to be produced and managed in the warehouse. This number, however, is much lower than what occurs for the equivalent supports of the prior art.

The invention might be subject to many changes and variants, which are all included in the appended claims. Moreover, all the details may furthermore be replaced by other technically equivalent elements, and the materials may be different depending on the needs, without departing from the protection scope of the invention defined by the appended claims.

The invention claimed is:

1. A support for raised floors comprising:

a base adapted to be positioned on a support surface; and a head operatively coupled to said base, said head comprising a support body and a tilting element laid on said support body, said tilting element having:

a portion having a circular upper surface that is at least partially flat so as to support a building element, and a lower surface; and one or more protrusions emerging from a circular crown of the lower surface of said portion to create an overall profile shaped as a spherical cap ring, an outer edge of said spherical cap ring being disposed at an outer perimeter of said circular upper surface of said tilting element, said support body having an upper surface with a cavity defined therein that is at least partially counter-shaped to said spherical cap ring at least at said one or more protrusions of said tilting element, wherein said base has a cylindrical through hole centrally, wherein said head is coupled to said base with a threaded connection, wherein said threaded connection comprises a first thread provided on a lateral surface of said head and a second thread provided on an inner surface of said cylindrical through hole of said base, wherein said head is coupled to said base via an interposition of an extension element, wherein said extension element is a cylinder having longitudinal ends, each longitudinal end having coupling means to said base or to another extension element, said cylinder comprising an inner surface threaded to engage said first thread provided on the lateral surface of said head, and wherein said coupling means are bayonet coupling means.

2. The support according to claim 1, further comprising means for engaging said tilting element onto said support body.

3. The support according to claim 1, wherein said one or more protrusions are a single protrusion that defines a spherical cap ring.

4. The support according to claim 1, wherein said one or more protrusions comprise a plurality of radial ribs.

* * * * *